United States Patent [19]

Sae

[11] 4,393,849

[45] Jul. 19, 1983

[54] VARIABLE IGNITION DISTRIBUTOR

[76] Inventor: Kim J. Sae, 11-43 Daebang-Dong, Dongjak-Gu, Seoul, Rep. of Korea

[21] Appl. No.: 257,174

[22] Filed: Apr. 24, 1981

[30] Foreign Application Priority Data

May 10, 1980 [KR] Rep. of Korea ..... 80-1843[U]

[51] Int. Cl.[3] ..... F02M 27/04; F02P 15/00

[52] U.S. Cl. ..... 123/536; 123/146.5 A; 123/640; 200/19 DC; 200/19 DR

[58] Field of Search ..... 123/146.5 A, 536, 640, 123/627, 620; 200/19 DR, 19 R, 25, 29, 80 R, 19 DC

[56] References Cited

U.S. PATENT DOCUMENTS 2,972,024 2/1961 Behrbaum ..... 200/19 DR X
3,019,276 1/1962 Harlow ..... 123/536 X
4,030,466 6/1977 Lace ..... 200/19 DR X

FOREIGN PATENT DOCUMENTS 55-46024 3/1980 Japan ..... 123/640

*Primary Examiner*—Tony M. Argenbright
*Attorney, Agent, or Firm*—Fleit, Jacobson & Cohn

[57] ABSTRACT

A variable ignition distributor for furnishing a high-voltage spark to a spark plug in a first cylinder and for furnishing a low-voltage spark to a spark plug in a second cylinder. A conventional distributor is modified so that a rotor of the distributor carries an ignition electrode for furnishing high voltage to the spark plug in the first cylinder and a variable electrode carried by the rotor furnishes low voltage to a spark plug in the second cylinder. The low voltage is generated at the same time as the high voltage so that there need be only one terminal connected to the ignition coil. Preferably, the variable electrode is adjustable so that the low voltage charge is furnished as a function of the operating speed of the engine.

11 Claims, 11 Drawing Figures

VARIABLE IGNITION DISTRIBUTOR

BACKGROUND OF THE INVENTION

This invention relates to a variable ignition distributor, more particularly to an improvement in an ignition distributor having a system of dual electrodes in a gasoline engine. Especially, this invention provides a variable ignition distributor which is capable of inhibiting the excessively rich mixture in the intake cylinder, reducing the delay time of flame propagation from the ignition electrode to the fuel and facilitating the complete combustion of the fuel, thereby saving the fuel and increasing the output of power of the gasoline engine. The invention provides a high-voltage spark to combust the fuel in the explosion cylinder and, by supplying and fine spark to the intake cylinder, ensures that optimum explosion environment can be formed in the intake cylinder. The invention further provides that the ionization of the fuel inhaled in the intake cylinder, as well as the compounding of the fuel with the air, can sufficiently be effected.

In most of the conventional distributors, the spark is directed to the air-fuel mixture compressed in the combustion chamber wherein explosion is effected, thereby output of power is produced, and, thereafter the fuel is inhaled again into the intake cylinder. At this time, the pistons are moved downward and the air which has passed through the air-cleaner will pass into the carburetor. The air from the carburetor is mixed with the fuel depending upon its flow speed and the air-fuel mixture is inhaled into the combustion chamber. The pressure of the air because of the downward moving of pistons is reduced to less than the atmospheric pressure. This phenomenon becomes severe with the increase of the rotation per minute of the engine and the flow rate of the air, which has passed through the carburetor, also becomes faster, thereby the fuel is poorly mixed with the air and is inhaled into each combustion chamber. Therefore, the explosion is effected by a spark, via the compression stroke, to the air-fuel mixture which is inhaled into the combustion chamber.

SUMMARY OF THE INVENTION

It is, therefore, a purpose of the present invention to provide a new variable ignition distributor exhibiting performance wherein the aforementioned problems of conventional ignition distributors are eliminated.

It is also an object of the invention to provide an ignition distributor wherein the suction of the excessively rich mixture is inhibited so that the best level of fuel can be supplied to the combustion chamber and the efficiency of the compression of the gasoline engines can be increased, with ionizing in advance the fuel thus supplied.

These objects of the invention can be attained by modifying the structures of both or either the cap and/or the rotor of the existing distributors. In other words, the distributor in accordance with the invention is designed to provide simultaneously different voltage-current to the explosion and the intake cylinders, depending upon the rotation per minute as well as the environment conditions of the engine.

BRIEF DESCRIPTION OF THE DRAWINGS

The present invention is in detail illustrated in the accompanying drawings, wherein.

DESCRIPTION OF THE DETAILED EMBODIMENT

Figure 1A:
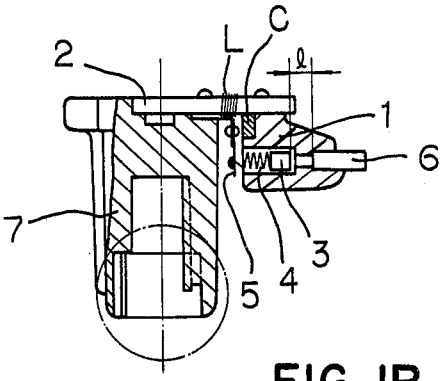
FIG 1(A) is a side cross-sectional view of the rotor of the variable ignition distributor in accordance with the invention.
Figure 1B:
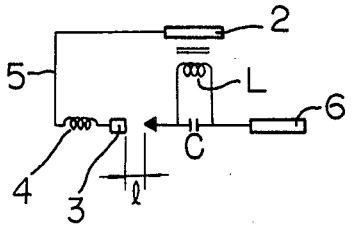
FIG. 1(B) is an electrical circuit diagram of the said variable rotor.

Referring now to FIG. 1(A), a variable ignition part 1 is made of an insulating material such as synthetic resin and is secured onto a conventional type of the electrode 2 so as to direct the high-voltage spark to the explosion cylinder mounted on the rotor 7 made of a synthetic resin. Between the variable ignition part 1 and the ignition electrode 2, as shown in FIG. 1(B), an electrical circuit is provided, wherein coil L is wound around the electrode 2 and a condenser C is connected in parallel with the coil L. The one end of the coil is connected to a variable electrode 6 so as to direct certain voltage to the intake cylinder, and the other end of the coil is interlaid so that a centrifugal contact point 3 and a tension spring 4 can induce a voltage-current of the ignition electrode 2 through a bimetal 5. Therefore, between the variable electrode 6 and the centrifugal contact point 3, a varied gap "l" is formed depending upon the rotation speed of the rotor 7.

Figure 2:
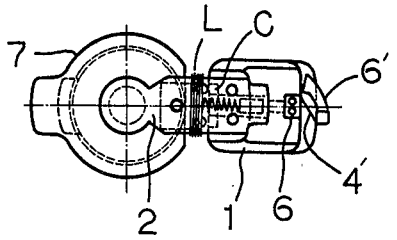
FIG. 2 is a top plan view of the rotor of FIG. 1.
Figure 3:
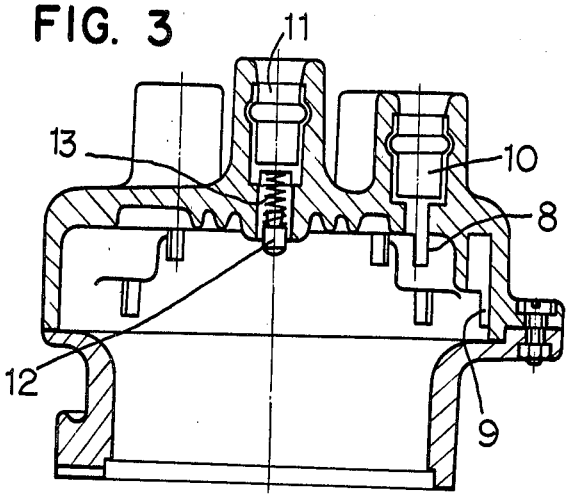
FIG. 3 is a longitudinal cross-sectional view of the cap of variable ignition distributor in accordance with the invention.

As can be seen from FIG. 2, a centrifugal electrode 6′ is mounted on the end of the variable electrode 6; this electrode 6′ is fitted with the spring 4′ so that the contact phase can differ from that of the fixed terminal 9 of the cap shown in FIG. 3. Namely, in order to secure the ionization of the fuel supplied into the intake cylinder which is apt to be reduced due to highspeed rotation of the engine, the centrifugal electrode 6′ is pulled outward so that it can compensate as much as the advance angle of the rotor electrode and the voltage can be directed to somewhat recessed intake position. To this end, the electrode 6′ is constituted to alter the angle of the position for transferring the spark component to the fixed terminal 9. That is, the centrifugal electrode 6′ is provided so that while forming an electric field defined between terminal 9 on the cap of the distributor and the variable electrode 6 by the coil L and the condenser C, by easily transferring the capacitance spark to the terminal 9 on the distributor cap connected to the intake cylinder, it may be possible to obtain a good distribution and an increased compression efficiency in compliance with the rotation conditions and the suddenly varied conditions of the engine.

In order to meet such conditions and to prevent disordered phenomenon due to direct voltage or current-shock to the contact point 3, which may occur when the condition of the engine is changed suddenly or highspeed is produced, the coil L and the condenser C are connected in parallel so that the leveling of the forming current transferred from the induction coil L and the contact point 3 can be attained and the reasonable conductivity onto the electrode 6 of the current over the whole rotation region of the engine can be effected.

In FIG. 3, the numeral 8 indicates the terminal for directing voltage to the terminal, that is, to the explosion cylinder. The numerals 10 and 11 indicate independently an inlet terminal 10 into which a terminal of high-tension cord connected to a spark-plug, and a terminal connected to the ignition coil; a central electrode 12, which is connected to the ignition electrode 2, is supported in the terminal 11 by a spring 13.

The current supplied to the spark-plug is determined depending upon the gap defined between the centrifugal contact point 3 and the primary electrode 6 by the centrifugal force supplied to the point 3 due to the rotation of the engine. Also, the current is changed depending upon the gap l of the electrode 6 and the point 3 due to the force of restitution of the spring 4 when the engine rotates at lower speed. In other words, the current other than that directed to the intake cylinder of the whole current is directed to the combustion chamber so that the delay time of combustion of the mixture in the intake cylinder can be changed to meet the spark time, and thus it is possible to obtain an optimum output efficiency. The bimetal 5 in the distributor 1 functions so as to compensate causes of uneven ignition state due to the change of the outer temperature of the engine and the temperature conditions when the engine is driven.

Figure 4:
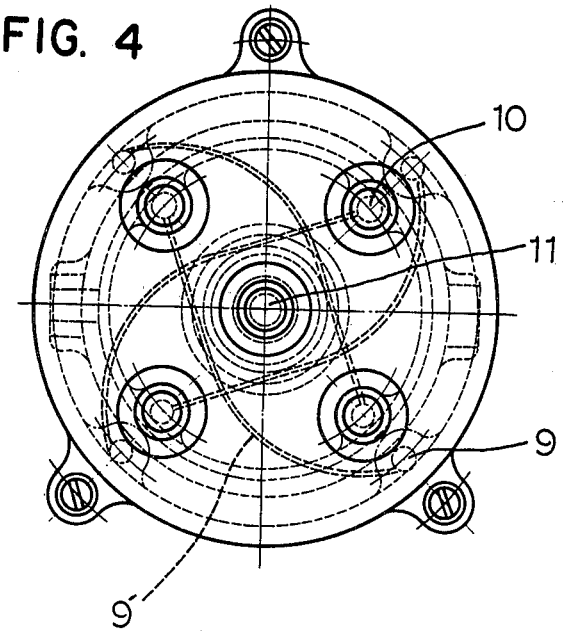
FIG. 4 is a top plan view of the cap of FIG. 3.

As shown in a dotted line in FIG. 4, the terminal 9 which is disposed in the position in accord with the terminal 8 connected to the combustion chamber on the distributor cap, is connected to terminal connected to the intake cylinder via a lead 9' interlaid in the cap.

Figure 5:
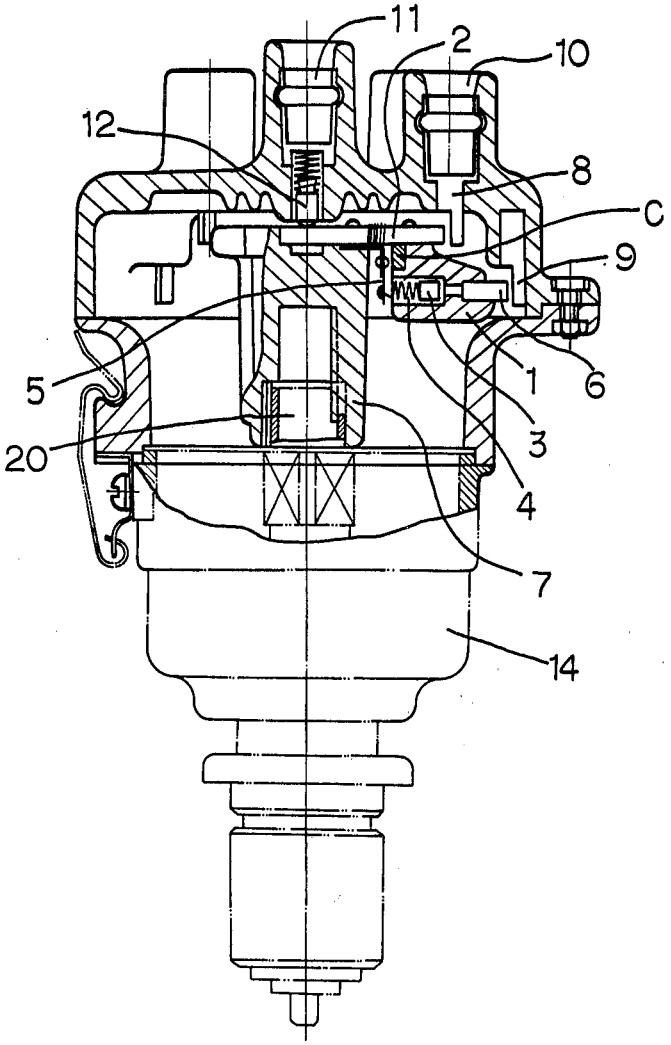
FIG. 5 is a partially cut-away cross-sectional view, showing the variable ignition distributor assembled in accordance with the invention.

FIG. 5 shows a partially cross-sectional view, wherein the aforementioned distributor cap is assembled with the rotor 7.

The rotor 7 is inserted into the camshaft 20 of the distributor system 14; this determines the shape of the insertion position of the rotor 7 depending upon the shape of the top end of the camshaft 20 of the distributor system 14.

In such structure, depending upon the number of cylinders of the engine, the dimension of the distributor cap, the diameter of the distributor cap, any interference with the outward portion of the engine, in case that the distance between the terminal to the intake cylinder and the expansion cylinder or the distance between the distributor electrodes to the expansion cylinder and the variable electrode to the intake cylinder is within a critical value less than insulated breaking strength, the diameters of the cap and the rotor may optionally be changed so that the space can be maintained broader than the critical value, or only the rotor structure may be modified.

FIG. 6 shows another embodiment of the rotor structure thus modified, differing from only the rotor structure in the existing distributor, to obtain the same efficiency of a variable ignition. In the distributor 14, the cap is the same as the conventional one, while only the rotor structure is changed. In the drawing, the numerals 2' and 21 indicate each an ignition electrode and a variable electrode. The centrifugal contact point 3' which controls the current to direct to the intake cylinder positioned in varied positions by the tension spring 4', so that the gap l' between the centrifugal contact point 3' and the contact point 15 of the bimetal 5' is changed in accordance with the rotation per minute of the engine.

The ignition electrode 2' is identical with the rotor of the conventional distributor in its shape; however a bimetal 5' for compensating the temperature is attached to the variable electrode 21. A contact point 15 is provided at the edge end of the bimetal 5'. A gap 1' between the centrifugal contact point 3' and a point 15 is determined depending upon r.p.m. of the engine, thereby the altered current can easily be supplied. The variable electrode 21 is provided with a centrifugal electrode 21', via a spring 22, for compensating the advance angle as shown in FIG. 1, and then in this result for securing the ionization of the mixture in the intake cylinder when the engine is rotating in high-speed. The electrode also is provided with a nut 16 so that the basic gap between the point 3' and the point 15 of the bimetal 5' can be properly controlled depending upon the engine conditions and/or the atmospheric environment. The rotating-relief plate 17, the control nut 16 and other element may be made of an insulating material such as a synthetic resin to prevent the electric leakage.

In the aforementioned second embodiment, the rotor 7' also is determined depending upon the shape of the top end of the camshaft of the distributor. In addition, the rotor 7' is designed so that the current connected to the intake cylinder also is determined depending upon the gap l' formed between the contact point 15 of the bimetal and the centrifugal contact point 3'. Such a gap may be changed when the point 3' is subject to certain centrifugal force, as the engine rotates during the state of maintaining a certain speed. Since the bimetal 5' is connected to the variable electrode 21, the current is distributed to the terminal 8 on the cap which is connected to the intake cylinder via the electrode 21. However, as the rotation rate of the engine is reduced, the gap is controlled by the restoring force of the tension spring 4', and, therefore, the current can be varied depending upon the situation, as mentioned above. Furthermore, in FIG. 6(A), the numerals 18 and 19 indicate each the variable gap of the bimetal 5' and the traveling gap of the centrifugal contact point 3'.

Figure 6A:
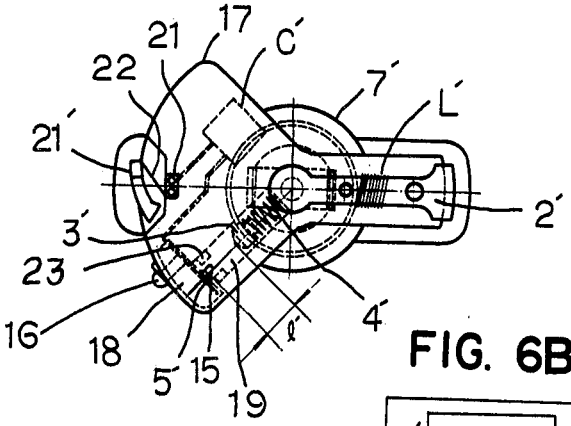
FIG. 6(A) is a top plan view of another embodiment of the rotor.

The stopper 23, as shown in FIG. 6(A), is provided to the travelling gap 19 of the centrifugal contact point 3' and this stopper has a job to prevent explosion in the intake cylinder when the centrifugal contact point 3' is directly contacted to the contact point 15 of the bimetal 5'.

Figure 6B:
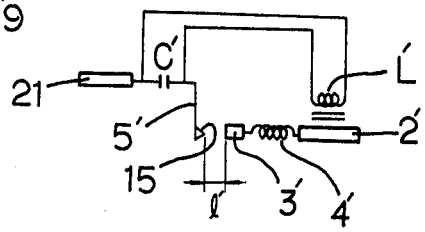
FIG. 6(B) is an electrical circuit diagram.
Figure 7:
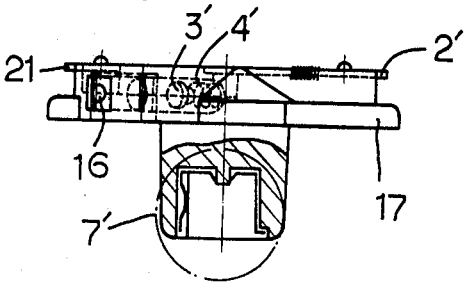
FIG. 7 is a side view of FIG. 6.
Figure 8:
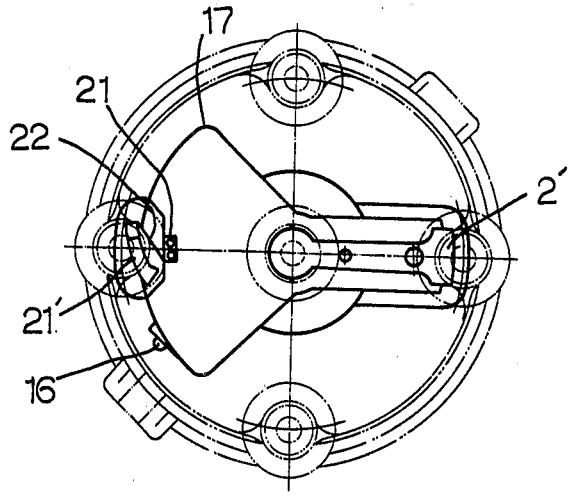
FIG. 8 is a top plan view showing the cap of the distributor of FIG. 6 assembled in accordance with the invention.
Figure 9:
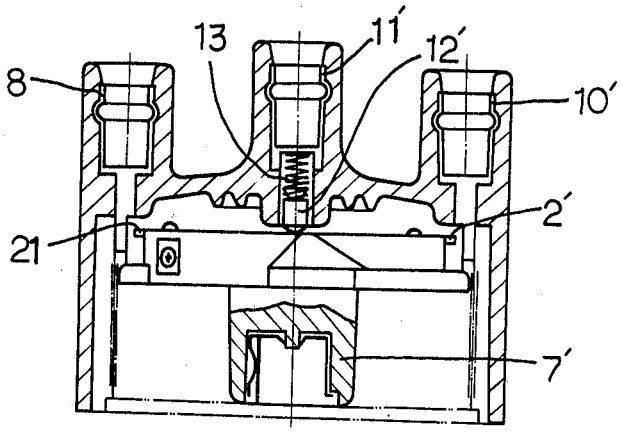
FIG. 9 is a side cross-sectional view of FIG. 8.

In FIG. 6(B), the induction coil L' and the smoothing condenser C' are connected to each other in parallel.

In the distributor in accordance with the invention, which employs the structures aforementioned, the distributing operation will be illustrated in order hereunder: When high voltage is supplied to the central inlet terminal 11' of the distributor cap from the ignition coil, the voltage is transferred to the ignition electrode 2' through the central contact electrode 12' with contacting the central portion of the rotor.

Accordingly, the spark component is distributed to the contact point 10' on the cap. At this time, in the centrifugal contact point 3', which is fitted to the end of the spring 4' connected to the ignition electrode 2', the current is determined depending upon the change of the gap in accordance with the rotation of the engine, and fine capacitance spark simultaneously is supplied to the terminal 8 connected to the intake cylinder by the variable electrode 21 via the point 15 of the bimetal 5' for compensating the temperature, thereby the first stage of combustion of the air-fuel mixture, that is, the ionization of and the compounding and the expansion of the fuel with the supplied air are effected.

The contact position of the explosion and the intake cylinders on the distributor cap is changed depending upon the number of the cylinders of the engine, and the position of the variable electrode 21 to the ignition electrode 2' also should be designed depending upon the same.

For instance, it is a principle that, in case of a four-cylinder engine, the ignition electrode 2' and the variable electrode 21 disposed in an opposite position, namely in a position of 180° to each other, in case of a six-cylinder engine, the variable electrode 21 should be positioned in the direction of 120° ahead with respect to the rotating direction to the electrode 2', and in case of a eight-cylinder engine, the variable electrode should be positioned in the direction of 90° ahead.

From the foregoing, it will be understood that the position of the variable electrode 21 is determined depending upon the angle defined between the terminal to the explosion cylinder of the distributor and the terminal to the intake cylinder.

While, in case that a certain angle between the variable electrode 21 and the centrifugal contact point 3' is defined and the variable electrode 21 and the ignition electrode come close to each other, a certain critical angle is maintained by increasing the diameters of the distributor cap and the rotor 7', it is possible to design so that the distance wider than the insulated breaking limit of the current can be obtained. Therefore, depending upon a situation, both the distributor cap and the rotor are or only the rotor is modified; in any case, the same effect is given.

In accordance with the invention, when the engine is operated, explosion is first effected and then end gases remain in non-combusted state within the combustion chamber exhausted from, whereupon the inlet valve is opened and thus the air is passed through the carburetor to form mixed air. At this time, the capacitance spark is supplied to the air-fuel mixture of the first stage which is inhaling through the carburetor. The spark causes the first stage of combustion of the air-fuel mixture, when the combustion is classified in three-stages, to the state that the ionization of fuel and the compounding of fuel with air is proceeded. Furthermore, at that time, the air-fuel mixture is passed in high speed through the spark-plug due to the inhaling force and no further combustion is effected, and, therefore, it is possible to eliminate completely knocking causes. Also, the air-fuel mixture is more or less expanded before beginning to burn in the combustion chamber at the first stage of combustion. This expansion reduces the extent of vacuum during the inhaling of air, and thus the flow speed of the air under inhaling is reduced. Consequently, such delay of the flow speed reduces the extent of vacuum in the carburetor so that the amount of the fuel supplied thereinto can be reduced, and the air-fuel mixture which has been subjected to the first stage of combustion is expanded to a certain volume; this expanded the mixture is compressed by the pistons. At this time, since the compressive force becomes higher than that in the conventional engine, the compressibility also is increased. By supplying a spark to the air-fuel mixture, which has been subjected to the first stage of combustion, by means of the spark-plug through the terminal and the ignition electrode, the second stage of combustion, the expansion of the spark spreads and the third stage of combustion are well proceeded. Therefore, the economy of the fuel and the production of the maximum output power of the engine can be attained in accordance with the complete combustion of the fuel.

What is claimed is:

1. A variable ignition distributor for furnishing a high-voltage spark to a spark plug in a first cylinder to initiate an explosion of a fuel-air mixture therein and for furnishing a low voltage spark to a spark plug in a second cylinder to enhance ionization of fuel supplied to the second cylinder prior to explosion of the fuel-air mixture in the second cylinder, said variable ignition distributor being usable with a distributor cap connected to an ignition coil and connected to the spark plugs in the first and the second cylinders and comprising:

a rotor disposed within the distributor cap;

an ignition electrode carried by said rotor for transferring a high voltage spark from the ignition coil to the spark plug in the first cylinder;

circuit means responsive to transfer of said high voltage spark for generating a low voltage spark; and a variable electrode carried by said rotor for transferring said low voltage spark to the second cylinder.

2. The variable ignition distributor of claim 1, wherein said variable electrode is secured to the said ignition electrode.

3. The variable ignition distributor of claim 1, wherein said circuit means comprises an induction coil wound around said ignition electrode and a condenser connected in parallel to said induction coil, one end of said coil being connected to said variable electrode and the current and the voltage of the ignition electrode being induced to the other end of the said coil, said variable ignition distributor further comprising a tension spring, a centrifugal contact point for inducing the low voltage spark in the other end of said coil, and a bimetal, said spring connecting said contact point with said bimetal.

4. The variable ignition distributor of claim 1, wherein a centrifugal electrode is fitted to a top end of said variable electrode.

5. The variable ignition distributor of claim 1, wherein the distributor cap has a fixed terminal and a contact point connected to said spark plug in said second cylinder, and a lead interlaid within said distributor cap, interconnecting said fixed terminal and said contact point.

6. The variable ignition distributor of claim 1, wherein the low voltage spark supplied to the spark plug in the second cylinder is determined depending upon a gap defined between the variable electrode and a centrifugal contact point associated therewith.

7. The variable ignition distributor of claim 1, wherein said distributor is used with an engine having a plurality of cylinders, a position angle between the variable electrode and the ignition electrode being determined by the position of contact points of spark plugs in cylinders in an expansion stroke and contact points of spark plugs in cylinders in an intake stroke.

8. The variable ignition distributor of claim 3, wherein the temperature is compensated by the bimetal.

9. In a distributor for an internal combustion engine comprising:

a distributor cap;

an inlet terminal provided on said distributor cap connectable to an ignition coil of the engine;

a plurality of terminals provided on said distributor cap connectable to individual spark plugs disposed in cylinders of the engine;

a rotor disposed within said distributor cap and positionable on a camshaft of a distributor system of the engine;

a contact member carried by said rotor for establishing an electrical circuit between the inlet terminal and individual ones of said terminals connectable to individual spark plugs as said rotor is rotated by said camshaft to thereby furnish main ignition charges to the spark plugs connected to said individual ones of said plurality of terminals, the improvement comprising:

a variable ignition electrode carried by said rotor for furnishing a low voltage spark to one of said individual ones of said terminals to thereby generate a spark in one of the cylinders to facilitate ionization of fuel in the cylinder prior to the main ignition charge being furnished said one cylinder; and means reponsive to establishment of an electrical circuit between the inlet terminal and an individual one of said terminals for furnishing power to said variable ignition electrode.

10. The improvement of claim 9, wherein said variable ignition electrode transfers the low voltage spark directly to individual ones of said plurality of terminals.

11. The improvement of claim 10, further comprising:

fixed contact points positioned on said distributor cap so as to receive charges from said variable ignition electrode during rotation of the rotor; and leads interlaid within the distributor cap interconnecting said fixed contact points with respective ones of said plurality of terminals.

* * * * *